US010173090B2

(12) United States Patent
Heymans

(10) Patent No.: US 10,173,090 B2
(45) Date of Patent: Jan. 8, 2019

(54) TENSIONING ELEMENT FOR TENSIONING A JUMPING MAT ON A FRAME OF A TRAMPOLINE

(71) Applicant: Joachim Heymans, Moorenweis (DE)

(72) Inventor: Joachim Heymans, Moorenweis (DE)

( * ) Notice: Subject to any disclaimer, the term of this patent is extended or adjusted under 35 U.S.C. 154(b) by 123 days.

(21) Appl. No.: 15/032,708

(22) PCT Filed: Oct. 28, 2014

(86) PCT No.: PCT/EP2014/073077

§ 371 (c)(1),
(2) Date: Apr. 28, 2016

(87) PCT Pub. No.: WO2015/063061

PCT Pub. Date: May 7, 2015

(65) Prior Publication Data

US 2016/0271436 A1 Sep. 22, 2016

(30) Foreign Application Priority Data

Oct. 30, 2013 (EP) ..... 13190782

(51) Int. Cl.
*A63B 5/11* (2006.01)
*A63B 21/055* (2006.01)

(52) U.S. Cl.
CPC ..... *A63B 5/11* (2013.01); *A63B 21/0552* (2013.01)

(58) Field of Classification Search
USPC ..... 482/27, 28; 24/81
See application file for complete search history.

(56) References Cited

U.S. PATENT DOCUMENTS

| | | | | |
|---|---|---|---|---|
| 3,788,323 | A * | 1/1974 | Robinson | A61F 13/64 24/305 |
| 5,275,578 | A * | 1/1994 | Adams | A63B 5/11 24/713.6 |
| 5,545,110 | A * | 8/1996 | Hsiang | A63B 5/11 482/27 |
| 2013/0316876 | A1* | 11/2013 | Publicover | A63B 5/11 482/27 |

FOREIGN PATENT DOCUMENTS

| | | | |
|---|---|---|---|
| DE | 2504875 | A1 | 8/1976 |
| DE | 10226707 | A1 | 1/2004 |
| WO | 2011/032173 | A2 | 3/2011 |

OTHER PUBLICATIONS

European Search Report issued in corresponding EP13190782 dated Mar. 24, 2014.

* cited by examiner

*Primary Examiner* — Sundhara Ganesan
(74) *Attorney, Agent, or Firm* — Carter, DeLuca, Farrell & Schmidt, LLP

(57) ABSTRACT

The invention relates to a tensioning element (1) for tensioning a jumping mat (15) on a frame (16) of a trampoline (19) with the aid of an elastic cable (18), wherein the tensioning element (1) comprises a basic body (2) with a plurality of retaining elements (3*a*-3*c*) for retaining the elastic cable (18). In order to allow variable adjustment of the mat tensioning, the invention proposes to provide a plurality of retaining elements (3*a*-3*c*) on the same side of the basic body (2), and therefore the elastic cable can be positioned optionally around one or more of the retaining elements (3*a*-3*c*).

10 Claims, 6 Drawing Sheets

TENSIONING ELEMENT FOR TENSIONING A JUMPING MAT ON A FRAME OF A TRAMPOLINE

Figures 1A, 1B, 1C, 1D:
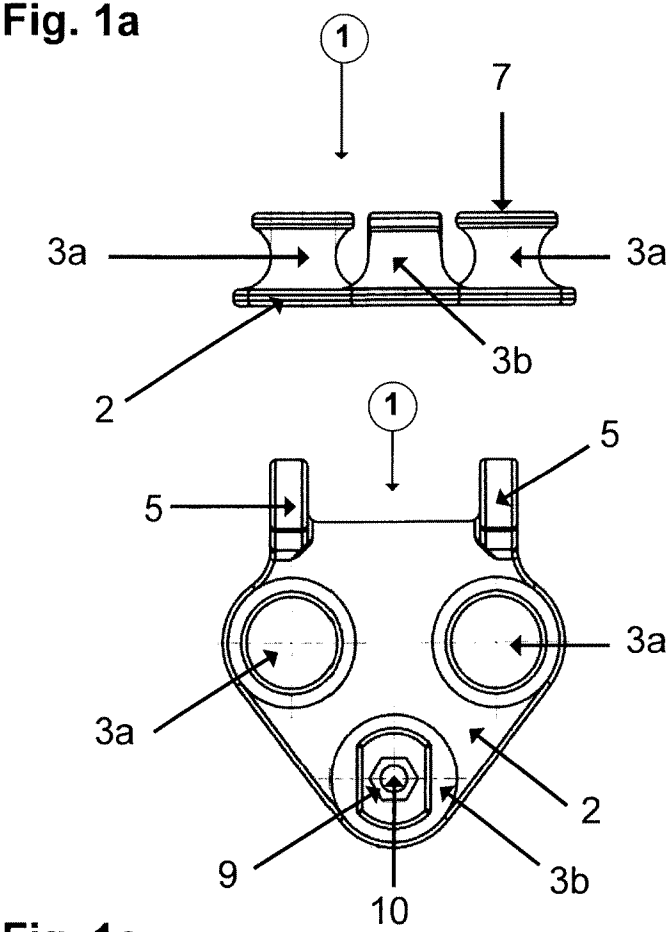
Figure 2A:
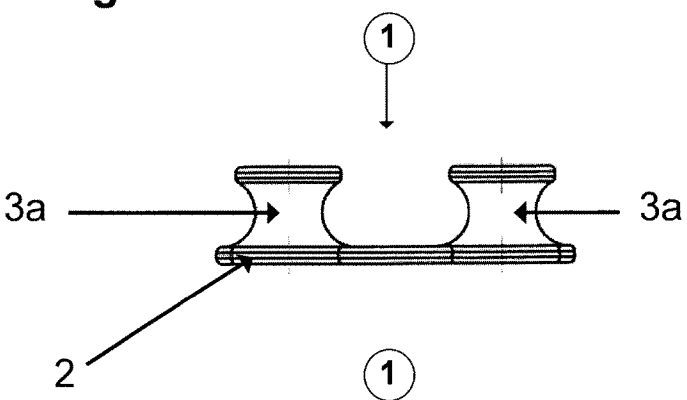
Figure 2B:
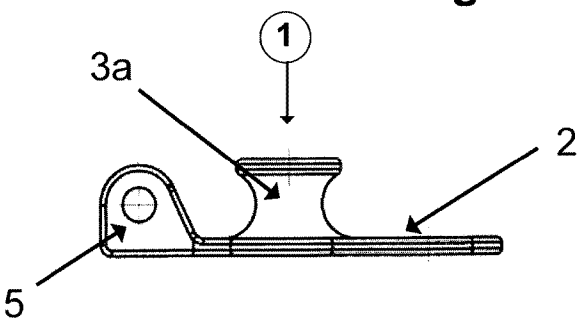
Figure 2C:
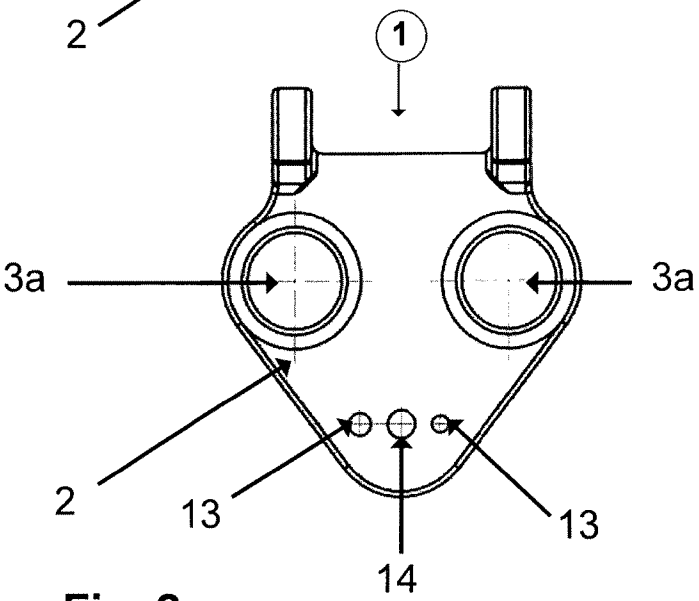
Figure 2D:
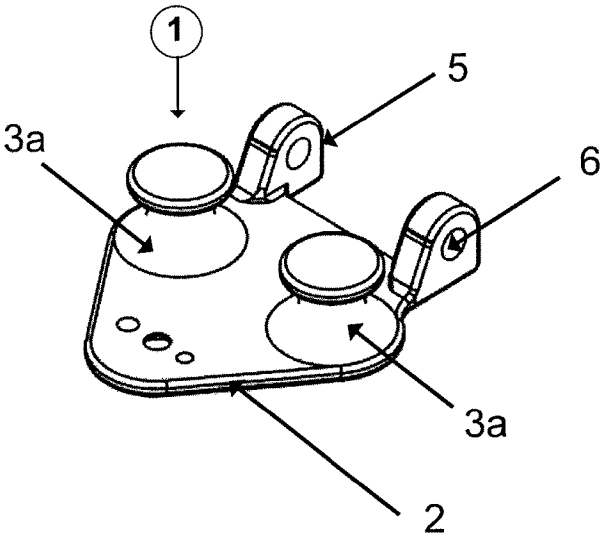
Figures 3A, 3B, 3C, 3D:
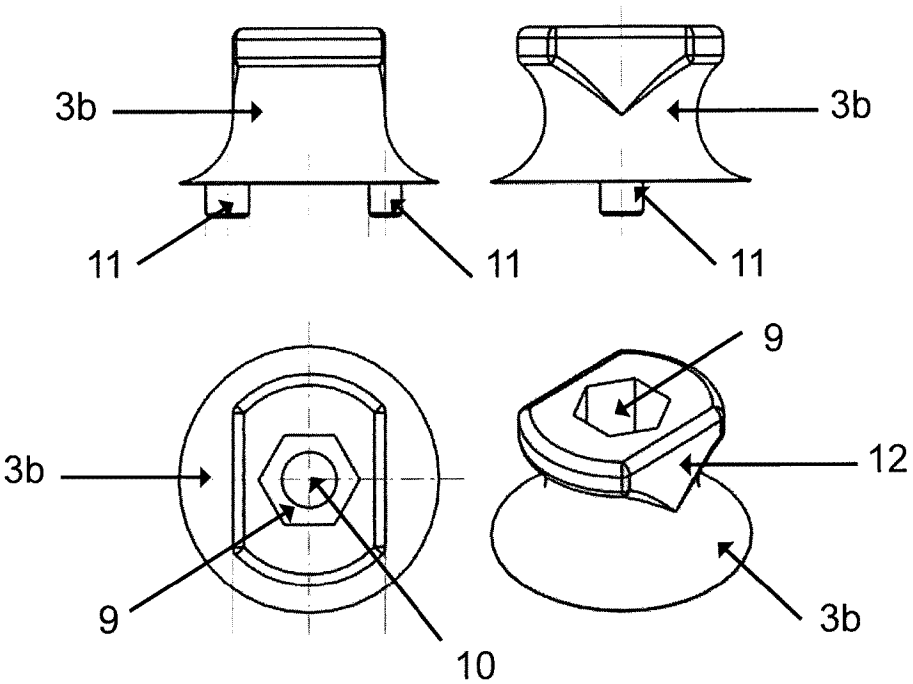

This application is a U.S. National Stage Application of International Application No. PCT/EP2014/073077, filed Oct. 28, 2014, the entire contents of which are incorporated herein by reference.

The invention relates to a tensioning element for tensioning a jumping mat on a frame of a trampoline with the aid of an elastic cable.

Trampolines known from prior art, to which reference is made below, substantially comprise a basic mount having an annular frame as well as a jumping mat which is suspended elastically within the frame. In the case of known trampolines, either springs or rubber cables are used for the elastic suspension of the jumping mat. Suspension by rubber cable, as a rule, has a higher elasticity which ensures a softer deceleration of the body and therefore a dampened jumping sensation. Suspension by spring is mostly harder.

A trampoline is known from DE 299 19 912 U1 in which the jumping mat is tensioned on the frame by means of a single elastic cable. Here, the cable is guided alternately around the frame of the trampoline and pulled through loops which are located on the bottom side of the jumping mat. Such a suspension, however, has the disadvantage that, in the event of a tear in the cable, the cable as a whole must be exchanged.

A trampoline is known from DE 10 2006 028 363 B3 in which the jumping mat is suspended on the frame with the aid of hook-shaped tensioning elements and by means of an elastic ring. The hook-shaped tensioning elements respectively have two receiving sections, of which one is arranged on the upper side and the other on the bottom side of the tensioning element. The elastic ring is, in this case, hung on one of the receiving sections with one end, then guided around the frame and is fastened to the second receiving section with its other end. The tensioning of the jumping mat is relatively simple in this case. Since the elastic rings are all the same size, the jumping mat is also aligned of its own accord in the centre of the frame.

DE 25 04 875 A1 discloses a tensioning element for tensioning a jumping mat on a frame of a trampoline with the aid of an elastic cable, which is guided in a loop from the frame to the tensioning element and back to the frame, wherein the tensioning element has a basic body having several retaining elements for retaining the elastic cable, wherein the retaining elements are arranged in such a way that the elastic cable can optionally be guided in different sizes of loops from the frame to the tensioning element and back to the frame. The known tensioning element, however, offers no possibility for fastening several cable ends.

Further tensioning elements are known from WO 2011/032173 A2 or DE 102 26 707 A1.

With the tensioning elements known from prior art, it is indeed possible to vary the tensioning of the jumping mat in order to adapt it, for example, to the body weight or in order to obtain jumping characteristics which are dampened to a greater or lesser extent, however it is not possible to also fasten several cable ends at the same time.

It is therefore an object of the present invention to create a tensioning element for tensioning a jumping mat on the frame of a trampoline, with which the tensioning of the jumping mat can be variably adjusted and furthermore, to which several cable ends can be fastened.

This object is solved according to the invention by the features specified in the independent claims. Further embodiments of the invention result from the sub-claims.

According to the invention, a tensioning element for tensioning a jumping mat on a frame of a trampoline is proposed which comprises a basic body with at least three retaining elements for retaining an elastic cable, wherein three of the retaining elements are arranged in the shape of a triangle. Therefore, the elastic cable can optionally be guided in different sizes of loops, i.e. on a shorter or longer path, from the frame to the tensioning element and back, wherein it has a lower or higher tension. The tensioning of the jumping mat can therefore be changed simply and without a tool. Furthermore, different cable ends can be hung on the free retaining elements.

With the tensioning elements fastened to the jumping mat, according to one embodiment of the invention, at least two retaining elements are arranged approximately at equal distance from the frame. In this embodiment, the cable can optionally be positioned around only one or around several retaining elements such that the cable tensioning can be varied.

Alternatively or additionally, however, at least one of the retaining elements can be arranged closer to the frame than a second retaining element. Mixed forms and arrangement variants are likewise conceivable. The elastic cable can therefore be guided on different paths around the retaining elements and the mat tensioning can therefore be regulated.

Fundamentally, the retaining elements can be located on one or on several sides of the basic body. According to one embodiment of the invention, several or possibly even all retaining elements are located on a single side, such as, for example, an upper side or bottom side of the basic body. If several retaining elements are provided on one side of the tensioning element, the elastic cable can optionally be positioned around a first, a second or around several of the retaining elements. Depending on how the cable is guided, the tensioning of the jumping mat can be adjusted either to be stronger or less strong. A loop of the elastic cable can, in this case, surround one or more retaining elements.

According to another exemplary embodiment, the retaining elements are located on different sides of the tensioning element. A first retaining element which is arranged on a first side, is, in this case, preferably located closer to the frame than a second retaining element which is arranged on a second side. The elastic cable can therefore optionally be positioned around the first or the second retaining element and therefore the mat tensioning can be varied. The first side can, for example, be an upper side, and the second side can be a bottom side of the tensioning element.

The retaining elements of the tensioning element can, for example be formed to be pillar-like. The retaining elements are preferably fastened at one end to the basic body of the tensioning element. The other end is preferably free.

The retaining elements preferably have a smaller cross-section at their central section than at their free end. The elastic cable can thereby be retained well in the tensioned state. The free, widened end of the retaining elements prevents the cable from sliding off the retaining elements.

According to a preferred embodiment of the invention, at least one of the retaining elements is formed in one piece with the basic body. The tensioning element can therefore be produced very simply from plastic, for example as an injection moulded part.

According to a specific embodiment of the invention, the retaining elements preferably extend along parallel axes. Several retaining elements can, however, also point in different directions.

The retaining elements are preferably formed to be rotationally symmetrical.

According to a preferred embodiment of the invention, the basic body of the tensioning element is formed to be planar.

As was described above, the retaining elements are preferably formed in one piece with the basic body. According to a specific embodiment of the invention, however, one or more of the retaining elements can be fastened releasably to the basic body. The fastening of a retaining element can, for example, occur with the aid of a screw connection. A tensioning element according to the invention preferably has one or more fastening positions to which a retaining element can be fastened. Releasable retaining elements have the advantage that the tensioning element can be configured according to requirement.

The tensioning element comprises suitable fastening means for fastening the tensioning element to the jumping mat. These means can, for example, have two extensions in which an opening for receiving a pin is provided respectively. The pin is, for example, plugged by a loop provided on the jumping mat and then fastened to the tensioning element. Alternatively, the tensioning element could also comprise a fastening flap which is, for example, suspended on hooks provided on the jumping mat. A wide variety of further fastening possibilities are known from prior art.

In one embodiment of the tensioning element in which all retaining elements are located on the same side of a basic body, the fastening means are preferably arranged such that the longitudinal axis of the retaining elements is aligned transversely to the tensile force of the elastic cable if the tensioning element is fastened to the jumping mat. In this case, no torsion occurs around the fastening point with the jumping map. In the case of a planar basic body, the fastening point at which the tensioning element is connected to the jumping mat therefore does not lie in the plane of the base plate, but offset to this, for example at the height of a retaining section to which the cable is fastened.

In one embodiment of the tensioning element in which the retaining elements are located on opposite sides of a basic body, the fastening point at which the tensioning element is connected to the jumping mat preferably lies exactly in the centre between the retaining sections of two retaining elements arranged on opposite sides.

The invention finally also relates to a trampoline having a frame on which the jumping mat is suspended elastically with the aid of a continuous cable or several cable pieces. The trampoline preferably comprises one or more of the tensioning elements described above. If the jumping mat is suspended using several cable pieces, each cable piece preferably runs around several tensioning elements such as, for example, 3 or 4 tensioning elements. Then the next cable piece follows.

SHORT DESCRIPTION OF THE DRAWINGS

Figure 4:
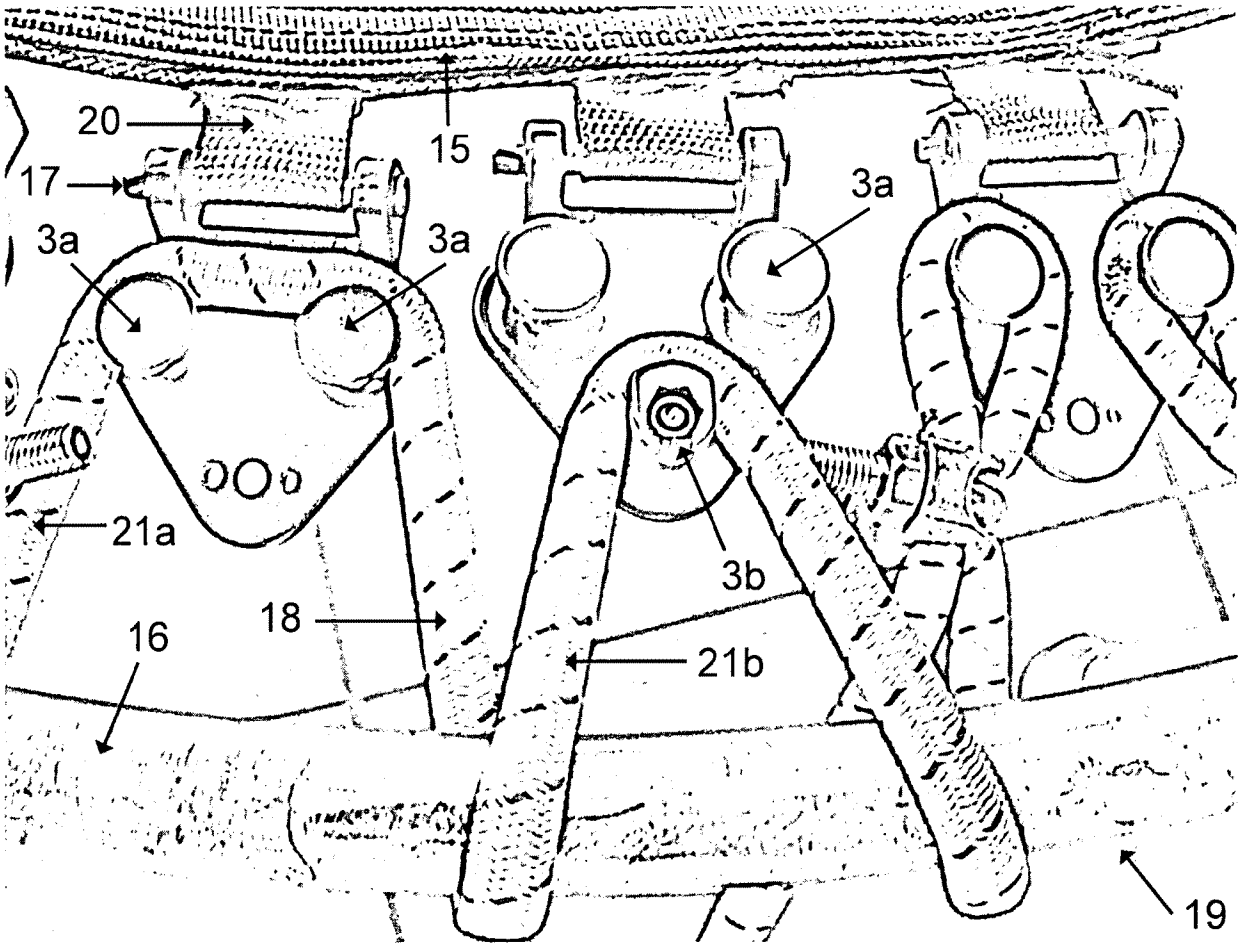
Figure 5A:
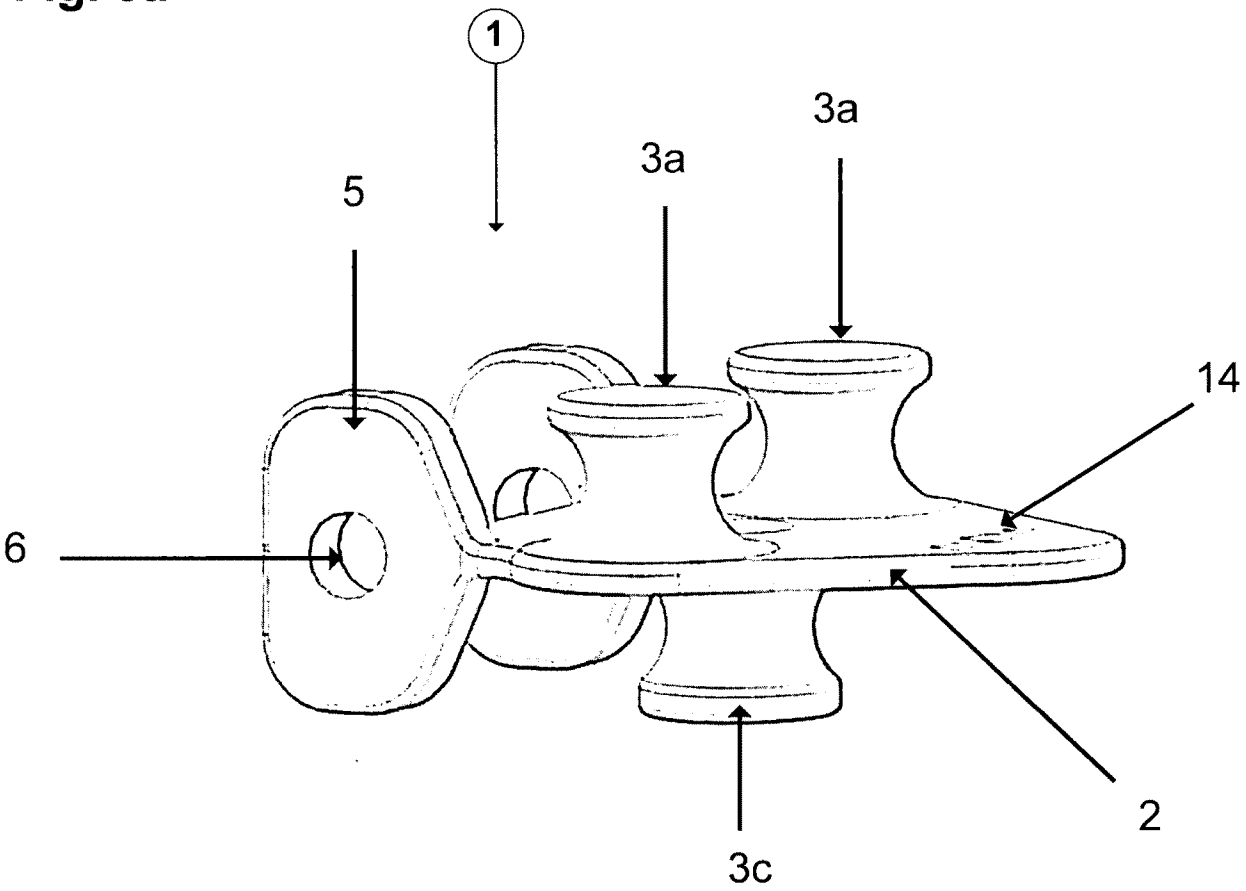
Figure 5B:
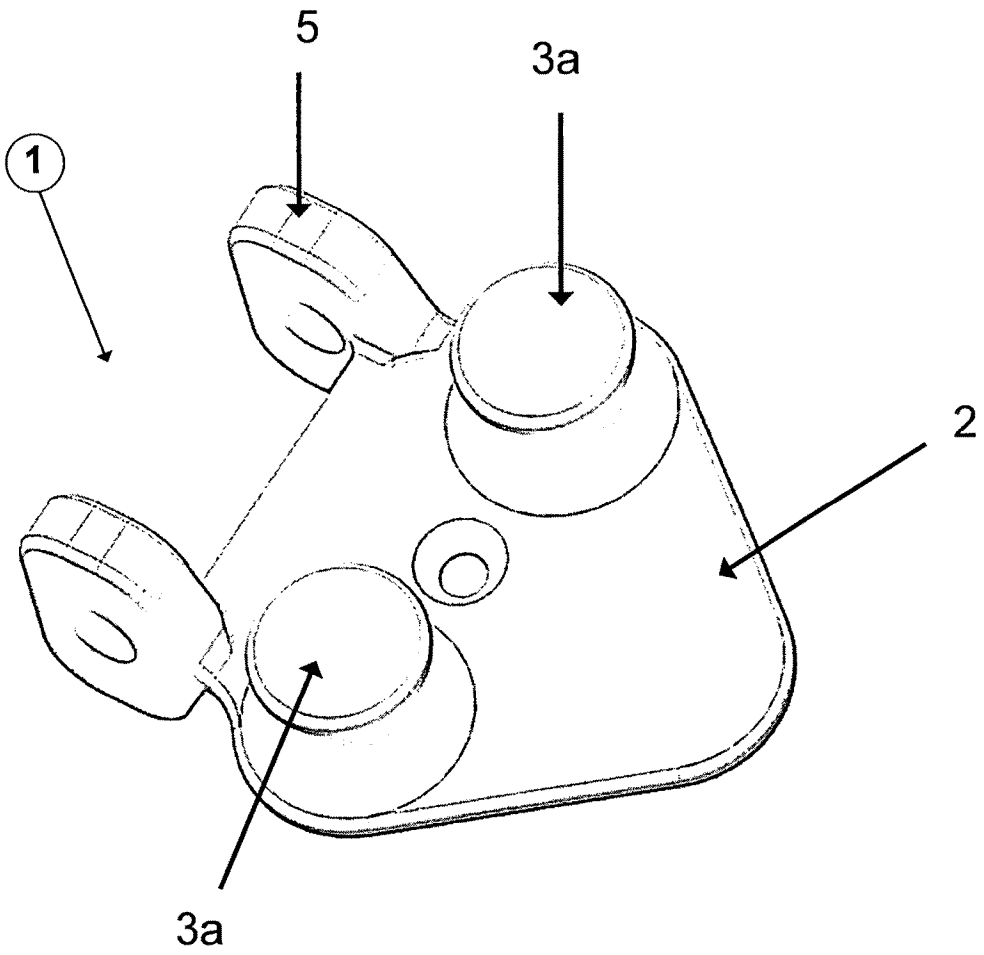

The invention is explained in more detail below by way of example by means of the enclosed drawings. Here are shown:

FIGS. 1*a*-1*d* different views of a tensioning element with three retaining elements according to one embodiment of the invention;

FIGS. 2*a*-2*d* different views of a tensioning element with two retaining elements according to one embodiment of the invention;

FIGS. 3*a*-3*d* different views of a retaining element which can be fastened releasably to a tensioning element;

FIG. 4 a depiction of different cable guiding variants in which the elastic cable can be guided around the retaining elements of FIGS. 1 and 2; and FIGS. 5*a*, 5*b* a further embodiment of a tensioning element in which the retaining elements are arranged on several sides of the tensioning element.

EMBODIMENTS OF THE INVENTION

FIGS. 1*a*-1*d* show different views of a tensioning element 1 for tensioning a jumping mat 15 (see FIG. 4) on the frame 16 of a trampoline 19 with the aid of an elastic cable 18. The tensioning element 1 comprises, in this embodiment, a planar basic body 2 on which three retaining elements 3*a*, 3*b* are provided. The retaining elements 3*a*, 3*b* are, in this case, arranged in a triangular configuration—more exactly in the shape of an isosceles triangle. In this arrangement, the elastic cable 18 can optionally be positioned around a single retaining element, such as, for example, retaining element 3*b*, or around several retaining elements, such as, for example, all retaining elements 3*a*, 3*b*.

If the elastic cable 18 is positioned around the retaining element 3*b*, the jumping mat is tensioned less strongly. If the elastic cable 18, however, is guided around one or both of the retaining elements 3*a*, the jumping mat 15 is tensioned more strongly. In order to change the mat tensioning, the user only has to change the cable guiding. This is possible in a very simple manner and can be implemented by anyone without any problems and without tools.

In the depicted embodiment, all retaining elements 3*a*, 3*b* are located on the same side of the basic body. Theoretically, however, one or more retaining elements 3*a*, 3*b* could also be provided on the other side of the tensioning element 1.

The retaining elements 3*a*, 3*b* are, in this case, formed to be column-shaped and have a central section 8 having a smaller cross-section on which the elastic cable comes to lie. The cross-section is, however, larger at its free end 7 in order to prevent the cable from sliding off the retaining element.

The individual retaining elements 3*a*, 3*b* are formed to be substantially cylindrical.

The two retaining elements 3*a* are here formed in one piece with the basic body 2. The overall part can therefore be produced simply from plastic, for example as an injection moulded part. The retaining element 3*b* is, however, fastened to the basic body 2 releasably by means of a screw connection. For this purpose, the retaining element 3*b* comprises, at its free end 7, a recess 9 to receive a hexagonal nut as well as a through-opening 10, through which a loop can be inserted from below and screwed with the nut (not shown).

In the exemplary embodiment of FIGS. 1*a*-1*d*, the retaining elements 3*a* are arranged such that they, if the tensioning element 1 is fastened to the jumping mat, are approximately at the same distance from the frame 20. The retaining element 3*b*, however, lies closer to the frame 20 than the retaining elements 3*a*.

In order to fasten the tensioning element 1 to the jumping mat 15, it comprises two extensions 5 which have an opening 6 for receiving a pin 17 respectively (see FIG. 4). The tensioning element 1 can therefore, for example, be fastened to a flap 20 provided on the jumping mat 15, as is depicted in FIG. 4.

FIGS. 2*a*-2*d* show different views of the tensioning element 1 from FIG. 1, in which, however, the retaining element 3*b* has been removed. As can be recognised in FIG. 2*c*, three passage openings 13, 14 are provided in the basic body 2 of the tensioning element 1. The opening 14 here serves for the passage of a screw, and the openings 13 for receiving a pin 11 provided on a retaining element 3*b*, as is depicted in FIGS. 3*a*-3*d*. The retaining element 3*b* can therefore only be put on the base plate 2 in a fixedly predetermined position. In the exemplary embodiment of FIGS. 3*a*-3*d*, the retaining element 3*b* comprises two pins 11 which project into one of the openings 13 respectively in the assembled state and serve as rotation locks. Optionally, only a single pin could also be provided.

FIGS. 3*a*-3*d* show an embodiment of a retaining element 3*b* which can be fastened to the basic body 2 of the tensioning element 1. The retaining element 3*b* has a substantially cylindrical body with concave side walls. The free end of the retaining element 3*b* is flattened on two opposite sides. The flattened surfaces thereby serve as contact surfaces 12 for a tool, such as, for example, a screw key.

Furthermore, on the free end of the retaining element 3*b*, there is a recess 9 to receive a hexagonal nut as well as an opening to plug through a screw. The socket of the retaining element 3*b* has a slightly larger cross-section than the free end of the retaining element 3*b*.

FIG. 4 shows a depiction of several tensioning elements arranged one next to the other and shows different possibilities, such as the jumping mat 15 being able to be tensioned with the aid of an elastic cable 18. In the case of the tensioning element 1 depicted in the image on the left, the elastic cable 18 is guided over the two retaining elements 3*a*. The loop 21*a* formed by the cable 18 is, in this case, proportionally large and the tensioning exerted on the jumping mat 15 is correspondingly high.

In the case of the tensioning element 1 depicted in the centre, the elastic cable 18 is only guided around the retaining element 3*b*. The loop 21*b* formed by the cable 18 is therefore relatively small and the tensioning exerted on the jumping mat 15 is correspondingly low.

As can be recognised in the image on the right, the cable end is formed into a loop by means of a clamp, said loop being positioned around a retaining element 3*a* of the right tensioning element 1.

In order to increase the mat tensioning from the depicted state, a user would only have to release the central loop of cable 18 from the retaining element 3*b* and, for example, position it around the two retaining elements 3*a*, similar to tensioning element 1 on the left. This can be implemented in a very simple manner and in particular without any problems and without tools.

FIGS. 5*a* and 5*b* shows a further embodiment of a tensioning element 1 in which the retaining elements 3*a*, 3*c* are arranged on several sides of the tensioning element 1. In the present case, two retaining elements 3*a* are located on the upper side, and a retaining element 3*c* on the bottom side of the planar basic body 2. The retaining element 3*c* is thereby fastened releasably to the basic body 2.

As can be recognised, the retaining elements 3*a*, 3*c* are all approximately at the same distance from the frame 16 of the trampoline if the tensioning element 1 is fastened to the jumping mat. The fastening points of the three retaining elements 3*a*, 3*c* lie on a straight line.

The fastening point 6 of the fastening means 5 is located exactly in the centre between the retaining sections of two retaining elements arranged on opposite sides. The opening 6 therefore lies in the plane of the basic body 2.

In the case of the embodiment depicted in FIGS. 5*a* and 5*b*, a further retaining element 3*b* (not shown) can also be arranged at the fastening point 14. The retaining element 3*b* would then lie closer to the frame 16 than the remaining retaining elements 3*a*, 3*c*. The cable tensioning could therefore be varied further.

The invention claimed is:

1. A tensioning element for tensioning a jumping mat on a frame of a trampoline, the tensioning element comprising:

a fastener for fastening the tensioning element to the jumping mat, and a basic body with at least three retaining elements, the retaining elements arranged on one side of the basic body in the configuration of a triangle to optionally guide an elastic cable, in different sizes of loops, from the frame to the tensioning element, around at least one of the retaining elements, and back to the frame.

2. The tensioning element according to claim 1, wherein, in a tensioned state of the elastic cable, at least one of the retaining elements is configured to be arranged closer to the frame than a second retaining element.

3. The tensioning element according to claim 1, wherein, in a tensioned state of the elastic cable, at least two of the retaining elements are configured to be arranged at the same distance from the frame.

4. The tensioning element according to claim 1, wherein at least one of the retaining elements has a first section having a smaller cross-section that is configured to abut the elastic cable while the elastic cable is disposed in a fastened state, and a second section having a larger cross-section, which is configured to prevent the elastic cable from sliding off the retaining element.

5. The tensioning element according to claim 1, wherein the basic body is formed to be planar.

6. The tensioning element according to claim 1, wherein at least one of the retaining elements is fastened releasably to the basic body.

7. The tensioning element according to claim 1, wherein the fastener has two extensions, each extension of the two extensions defining an opening for receiving a pin.

8. The tensioning element according to claim 1, wherein the fastener is arranged such that a longitudinal axis of the retaining elements is aligned transversely to a tensile force direction of the elastic cable while the tensioning element is fastened to the jumping mat.

9. A trampoline having a frame, a jumping mat, and an elastic cable that is guided in a loop from the frame to the tensioning element of claim 1 and back to the frame.

10. The trampoline according to claim 9, wherein the jumping mat is tensioned by cable pieces that are hung on several tensioning elements of the trampoline, respectively.

* * * * *